United States Patent [19]

Penney

[11] 4,081,198

[45] Mar. 28, 1978

[54] TRAY FOR TUBULAR ARMCHAIR

[76] Inventor: Richard C. Penney, 430 W. Mendota Rd., W. St. Paul, Minn. 55118

[21] Appl. No.: 765,535

[22] Filed: Feb. 4, 1977

[51] Int. Cl.[2] ..... A47B 39/00
[52] U.S. Cl. ..... 297/153
[58] Field of Search ..... 297/148–153

[56] References Cited

U.S. PATENT DOCUMENTS

| | | | |
|---|---|---|---|
| 1,008,037 | 11/1911 | Johnson | 297/153 |
| 2,937,694 | 5/1960 | Willson et al. | 297/153 |

*Primary Examiner*—James C. Mitchell

[57] ABSTRACT

Tray for wheel chairs or the like is supported by cantilever suspension, on knobs of which those on one side are movable by one-handed manipulation in a direction away from the attached ends of said knobs, to permit easy installation on, and removal from, said chair.

7 Claims, 15 Drawing Figures

TRAY FOR TUBULAR ARMCHAIR

Figure 1:
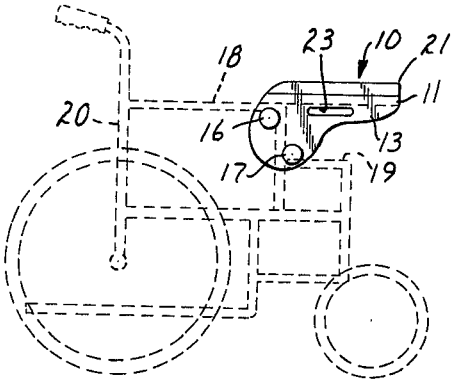

This invention relates to tray structures which are readily removable attachable to chairs of tubular construction such for example as wheel chairs. In one particular aspect the invention relates to a tray which may be mounted on, and removed from, a wheel chair by a partially disabled occupant having the use of but one hand and arm.

Trays for wheel chairs and the like have conventionally been mounted either by strapping the projecting side supports to the arms of the chair, or by slidably inserting the projecting supports into open-ended tubular receptor channels permanently attached to the chair arms. In either case it is difficult, if not virtually impossible, for a disabled person, who is confined to the chair, to attach or remove the tray.

The present invention provides an improvement in trays for wheel chairs and the like, whereby a disabled occupant of the chair, having the use of but one hand and arm, is enabled to mount and remove the tray unaided. The improved tray is supported on the chair as a cantilever, by means of laterally extending knobs carried by depending tray-supporting wings or side members and contacting opposite sides of the tubular arms of the chair. At least one set of knobs is displaceable in a direction away from the unattached free ends of the knobs so as to permit the wings to pass the chair arms during attachment or removal of the tray. In day-to-day usage the tray will normally be adjusted to fit one specific chair; but adjustments for fitting it to other chairs or for the convenience of other occupants or for other uses may be provided.

Figure 2:
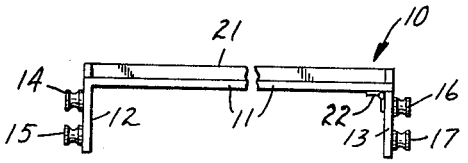
Figure 7:
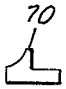
Figure 4:
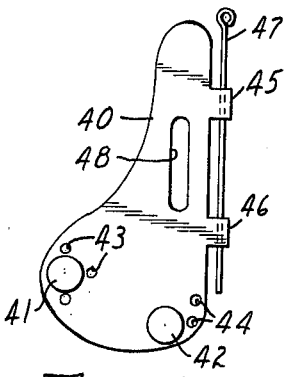
Figure 3:
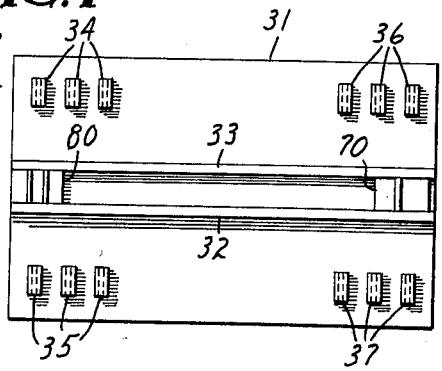
Figure 5:
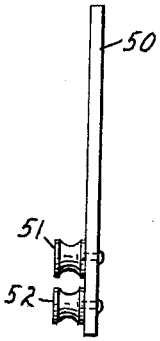
Figure 6:
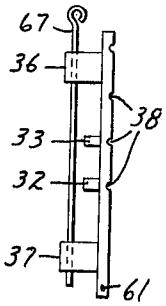
Figure 9:
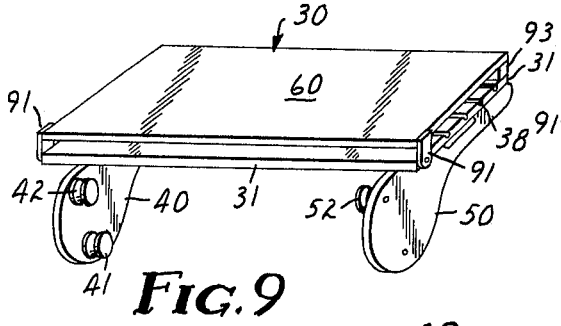
Figure 10:
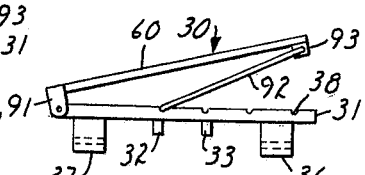
Figure 8:
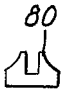
Figure 12:
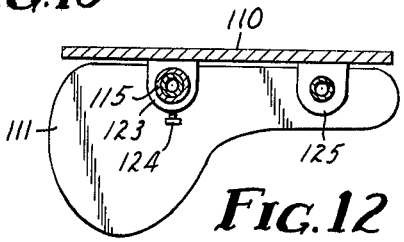
Figure 11:
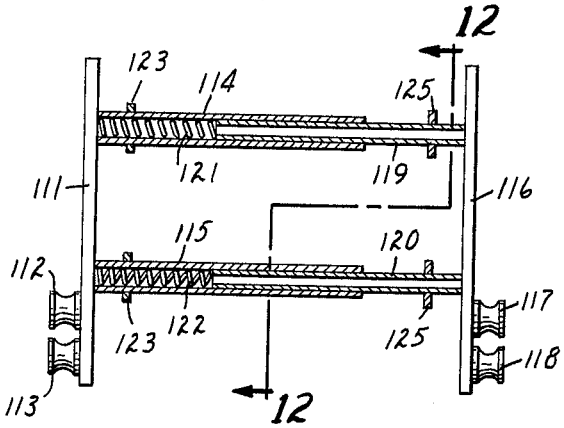
Figure 13:
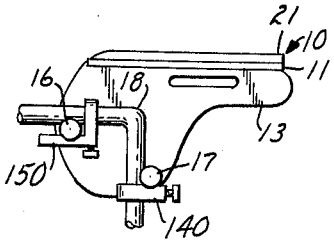
Figure 15:
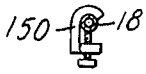
Figure 14:
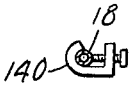

In the drawing,

FIG. 1 is a side elevation of one form of tray made in accordance with the principles of the invention and in place on a hemi-chair shown in phantom, FIG. 2 is a front end elevation of the tray of FIG. 1, FIG. 3 is a bottom plan view of the base of a modified form of tray, FIG. 4 is a side view showing one of the wings for the base of FIG. 3, FIG. 5 is a bottom edge view showing the opposing wing, FIG. 6 is an edge view of the base, and FIGS. 7 and 8 are side elevations of central supporting members for the wings of FIGS. 4 and 5, FIG. 9 is a view in perspective of an adjustable tray comprising the base and dependent wings of FIGS. 3–5, FIG. 10 is a partial side elevation of the tray of FIG. 9 depicting one form of adjustment, FIG. 11 is a partial top plan view, partly in section, of the supporting structure of a different form of tray, FIG. 12 is a partial edge view, partly in section as indicated at section 12—12 of FIG. 11, of portions of the structure of FIG. 11, FIG. 13 is a side elevation of an adjustable tray supported on a standard type wheel chair arm, and FIGS. 14 and 15 are end views of the retaining clamps shown in FIG. 13.

The tray 10 of FIGS. 1 and 2 will be seen to comprise a base 11 and two depending wings 12, 13 each carrying two knobs 14, 15, 16, 17 in position to support the base as a cantilever from the tubular arms 18, 19 of the chair 20. A retaining edge wall 21 may optionally be provided along the upper front and side edges of the base. The wing 13 is hingedly attached to the base by hinge 22, and is optionally provided with a hand-opening 23, permitting an occupant of the chair to fold the wing against the bottom of the base while supporting the entire tray structure with the one hand. If desired, spring means, not shown, may be incorporated to bias the wing 13 gently toward the open position illustrated. The tray shown in FIGS. 1 and 2 is for handling with the right hand; for use with the left hand, the left wing 12 is analogously hinged and provided with a handhold.

The tray 30 of FIGS. 3 – 10 comprises a base 31, a stationary wing 40, a foldable wing 50, and an adjustable leaf or tray top 60. The base carries two central parallel ridges 32, 33 and four groups of spaced perforate hinge blocks 34 – 37, for purposes to be described.

The wing 40 carries two knobs 41, 42 which may be attached as desired at any of the perforations 43, 44 provided for the purpose. The wing is provided with hinge blocks 45, 46 positioned to lie in juxtaposition with opposing blocks 34, 35 and held in such position by a hinge pin 47 passing through the several blocks. When in position on the base 31, wing 40 is retained perpendicularly thereto by a slotted brace 80 fitting between ridges 32, 33 and in line with the blocks 34, 35 through which the pin 47 is passed.

The opposing wing 50 similarly attaches to selected aligned hinge blocks 36, 37 by hinge pin 67 and is prevented from folding toward the base 31 by a brace block 70 which however permits the wing to be folded outwardly, i.e. in the direction away from the inwardly disposed knobs 51, 52.

The wing members 40, 50 are for reasons of interchangeability made identical, each being provided with an opening 48 serving as a handhold. It will be seen that foldability may be imparted to either of said wings simply by interchange of brace members 70, 80. The ridges 32, 33 serve not only to guide and retain the brace members but also to reinforce the base 31, thereby making possible a tray structure of reduced weight.

As shown in FIGS. 9 and 10, the base 31 supports a leaf 60 serving as the tray surface. Hinge blocks 91 affixed to the leaf 60 are pivoted on hinge pins passing into mating apertures 61 (FIG. 6) in the base. A generally U-shaped rigid wire support member 92 with ends pivoted in an edge block 93 supports the leaf 60 at any desired angle with the base 31 when the base of the U is retained in the desired one of grooves 38.

The structure shown in FIGS. 11 and 12 involves a different method of operation. It comprises a base 110, a first wing 111 carrying knobs 112, 113 and tubes 114, 115, and a second wing 116 carrying knobs 117, 118 and tubes or rods 119, 120 fitting within the opposing tubes 114, 115 as shown. Compression springs 121, 122 bias the two wings apart.

The base 110 is mounted on D-rings supported on the tubes 114, 115 and 117, 118. D-rings 123 fit the larger tubes 114, 115 and as illustrated in FIG. 12 are capable of being anchored thereto by setscrews 124. D-rings 125 fit slidingly on the smaller tubes 119, 120 and may optionally include provision for being anchored thereto.

In use, the tray of FIGS. 11 and 12 is mounted on the chair by supporting the tray at either side with one hand, pressing the opposite edge of the tray against the adjoining chair arm, positioning the hand-held wing as required, and then permitting the wings to be forced apart, by the expansion of springs 121, 122, between the arms of the chair.

For use with other forms of tubular chair arms, or where it is desired to support the tray at a higher level or at a different distance from the occupant of the chair, auxiliary clamp members as illustrated in FIGS. 13 – 15 may be found useful. Thus, clamp 140 on the vertical component of chair arm 18 supports knob 17, and clamp 150 on the horizontal component of arm 18 supports knob 16. Substituting a second clamp 150 for clamp 140 permits the tray to be supported either closer to or farther from the occupant.

It is to be understood that features shown in connection with any of the specific structures described and illustrated herein may be equally applicable to others of such structures; for example, the adjustable knobs of FIGS. 4 and 13, and the angularly adjustable leaf of FIGS. 9 and 10, are useful also in the remaining tray structures. While cantilever knobs have been illustrated chiefly in the form of spools, it will be apparent that pegs, hooks or other analogous cantilever retaining and supporting members are equally applicable. The edge wall 21 of the tray 10 may be included on the base 110 of FIG. 12 or on the leaf 60 of FIG. 9. A wall member along the inner edge of the tray may also be included if desired. Again, the device of FIG. 11 may be made with tension rather than compression springs and with the knobs mounted on the inner rather than the outer surfaces of the wings.

What is claimed is as follows:

1. A tray assembly adapted for removable attachment to a wheel chair, comprising a flat base, two supporting wings one at each side of and perpendicular to said base, and knobs extending laterally from each of said supporting wings in position to provide cantilever support from the arms of said chair to said tray by bearing against opposite sides of said arms, at least the knobs of at least one of said wings being movable toward and away from the other of said wings so as to permit said removable attachment.

2. Tray assembly of claim 1 wherein said knobs are adjustably carried by said wings for changing the position of said tray relative to an occupant of said chair.

3. Tray assembly of claim 1 wherein the motion of said movable knobs is permitted by hinge attachment to said base of the wing supporting said knobs.

4. Tray assembly of claim 1 wherein said wings are supported on telescoping structure for maintaining said wings in parallel planes at variable distances apart and said base is slidably supported on said structure.

5. Tray assembly of claim 3 wherein each of said wings includes hinge components and said base includes two sets of hinge components for cooperative association with said wing hinge components in adjusting the distance between said wings.

6. Tray assembly of claim 5 wherein said base includes a pair of reinforcing ridges extending between the side edges of said base, and brace blocks fitting between said ridges and against said wings for positioning said wings perpendicular to said base, one of said blocks permitting folding of the corresponding wing about its said hinge components in a direction away from the other of said wings.

7. Tray assembly of claim 1 wherein is included a leaf member hingedly supported on said base, and means for supporting said leaf member at any desired angle with said base.

* * * * *